United States Patent [19]

Mazor et al.

[11] Patent Number: 4,790,016

[45] Date of Patent: Dec. 6, 1988

[54] ADAPTIVE METHOD AND APPARATUS FOR CODING SPEECH

[75] Inventors: Baruch Mazor, Newton; Dale E. Veeneman, Southborough, both of Mass.

[73] Assignee: GTE Laboratories Incorporated, Waltham, Mass.

[21] Appl. No.: 798,174

[22] Filed: Nov. 14, 1985

[51] Int. Cl.[4] ..... G10L 5/00

[52] U.S. Cl. ..... 381/36; 381/39; 381/50; 364/513.5

[58] Field of Search ..... 381/36, 37, 39, 41, 381/42, 50, 51; 364/513.5

[56] References Cited

U.S. PATENT DOCUMENTS

| | | | |
|---|---|---|---|
| 4,184,049 | 1/1980 | Crochiere et al. | 381/41 |
| 4,283,601 | 8/1981 | Nakajima et al. | 364/513.5 |
| 4,310,721 | 1/1982 | Manley et al. | 364/513.5 |
| 4,330,689 | 5/1982 | Kang et al. . | |
| 4,381,428 | 4/1983 | Kolesar et al. | 364/513.5 |
| 4,388,491 | 6/1983 | Ohta et al. . | |
| 4,535,472 | 8/1985 | Tomik . | |

FOREIGN PATENT DOCUMENTS

| | | |
|---|---|---|
| EP-A-0124728 | 11/1984 | European Pat. Off. . |
| EP-A-0176243 | 4/1986 | European Pat. Off. . |
| DE-A-3102822 | 8/1982 | Fed. Rep. of Germany . |

OTHER PUBLICATIONS

James L. Flanagan et al., "Speech Coding", *IEEE Transactions on Communications*, vol. Com-27, No. 4, pp. 710–736, Apr. 1979.

George S. Kang et al., "Mediumband Speech Processor with Baseband Residual Spectrum Encoding" Proceedings 1981 *IEEE, International Conference on Acoustics*, Speech and Signal Processing, pp. 820–823.

B. N. Suresh Babu, "Performance of an FFT-Based Voice Coding System in Quiet and Noisy Environments," *IEEE Transactions on Acoustics, Speech and Signal Processing*, vol. ASSP-31, No. 5, Oct. 1983, pp. 1323–1327.

*Primary Examiner*—Peter S. Wong

*Attorney, Agent, or Firm*—Hamilton, Brook, Smith & Reynolds

[57] ABSTRACT

In a speech coding system, scale factors are generated and encoded for each of a plurality of subbands of a Fourier transform spectrum of speech. Based on those scale factors, the spectrum is equalized. Coefficients of a limited number of subbands determined by the scale factors are encoded. The number of bits used to encode each coefficient of each transmitted subband is determined by the scale factor for each subband. At the receiver, coefficients of subbands which are not transmitted are approximated by means of a list replication technique.

19 Claims, 3 Drawing Sheets

Fig. 4
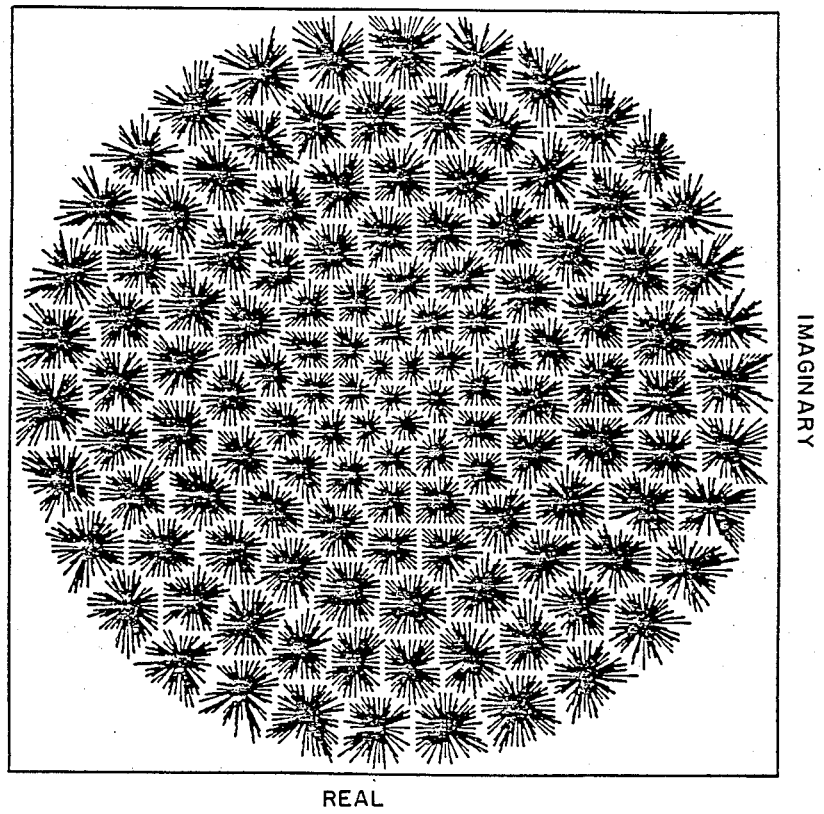
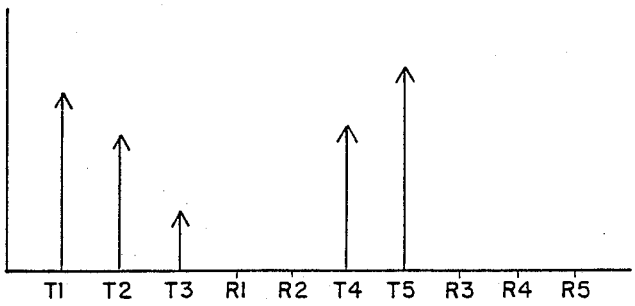
Fig. 5

ADAPTIVE METHOD AND APPARATUS FOR CODING SPEECH

FIELD OF THE INVENTION

The present invention relates to digital coding of speech signals for telecomunications and has particular application to systems having a transmission rate of about 16,000 bits per second or less.

BACKGROUND

Conventional analog telephone systems are being replaced by digital systems. In digital systems, the analog signals are sampled at a rate of about twice the bandwidth of the analog signals or about eight kilohertz, and the samples are then encoded. In a simple pulse code modulation system (PCM), each sample is quantized as one of a discrete set of prechosen values and encoded as a digital word which is then transmitted over the telephone lines. With eight bit digital words, for example, the analog sample is quantized to $2^8$ or 256 levels, each of which is designated by a different eight bit word. Using nonlinear quantization, excellent quality speech can be obtained with only seven bits per sample; but since a seven bit word is still required for each sample, transmission bit rates of 56 kilobits per second are necessary.

Efforts have been made to reduce the bit rates required to encode the speech and obtain a clear decoded speech signal at the receiving end of the system. The linear predictive coding (LPC) technique is based on the recognition that speech production involves excitation and a filtering process. The excitation is determined by the vocal cord vibration for voiced speech and by turbulence for unvoiced speech, and that actuating signal is then modified by the filtering process of vocal resonance chambers, including the mouth and nasal passages. For a particular group of samples, a digital filter which simulates the formant effects of the resonance chambers can be defined and the definition can be encoded. A residual signal which approximates the excitation can then be obtained by passing the speech signal through an inverse formant filter, and the residual signal can be encoded. Because sufficient information is contained in the lower-frequency portion of the residual spectrum, it is possible to encode only the low frequency baseband and still obtain reasonably clear speech. At the receiver, a definition of the formant filter and the residual baseband are decoded. The baseband is repeated to complete the spectrum of the residual signal. By applying the decoded filter to the repeated baseband signal, the initial speech can be reconstructed.

A major problem of the LPC approach is in defining the formant filter which must be redefined with each window of samples. A complex encoder and a complex decoder are required to obtain transmission rates as low as 16,000 bits per second. Another problem with such systems is that they do not always provide a satisfactory reconstruction of certain formants such as that resulting, for example, from nasal resonance.

Another speech coding scheme which exploits the concepts of excitation-filter separation and excitation baseband transmission is described by Zibman in U.S. patent application Ser. No. 684,382, filed Dec. 20, 1984. In that approach, speech is encoded by first performing a Fourier transform of a window of speech. The Fourier transform coefficients are normalized by making a piecewise-constant approximation of the spectral envelope and scaling the frequency coefficients relative to the approximation. The normalization is accomplished first for each formant region and then repeated for smaller subbands. Quantization and transmission of the spectral envelope approximations amount to transmission of a filter definition. Quantization and transmission of the scaled frequency coefficients associated with either the lower or upper half of the spectrum amounts to transmission of a "baseband" excitation signal. At the receiver, the full spectrum of the excitation signal is obtained by adding the transmitted baseband to a frequency translated version of itself. Frequency translation is performed easily by duplicating the scaled Fourier coefficients of the baseband into the corresponding higher or lower frequency positions. A signal can then be fully recreated by inverse scaling with the transmitted piecewise-constant approximations. This coding approach can be very simply implemented and provides good quality speech at 16 kilobits per second. However, it performs poorly with non-speech voice-band data transmission.

DISCLOSURE OF THE INVENTION

The present invention is a modification and improvement of the Zibman coding technique. As in that technique, a discrete transform of a window of speech is performed to generate a discrete transform spectrum of coefficients. Preferably the transform is the Fourier transform. The approximate envelope of the transform spectrum in each of a plurality of subbands of coefficients is then defined and each envelope definition is encoded for transmission. Each spectrum coefficient is then scaled relative to the defined envelope of the respective subband. In accordance with the present invention, each scaled coefficient is encoded in a number of bits which is determined by the defined envelope of its subband.

Zero bits may be allotted to a number of less significant subbands as indicated by the defined envelopes; and varying numbers of bits may be used for each encoded coefficient depending on the magnitude of the defined envelope for the respective subband. Thus, the subbands which are transmitted and the resolution with which the transmitted subbands are encoded are determined adaptively for each sample window based on the defined envelopes of the subbands.

At the receiver, the subbands which are transmitted are replicated to define coefficients of frequencies which are not transmitted. A list replication procedure is followed by which an nth coefficient which is transmitted is replicated as an nth coefficient which is not transmitted. After replication the speech signal can be recreated by using the transmitted envelope definitions to inverse scale the coefficients of the respective subbands and by performing an inverse transform.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

FIG. 4 schematically illustrates a quantizer for complex values of the normalized spectrum.

FIG. 5 is an example illustration of coefficient groups which are transmitted and illustrates the replication technique of the present invention.

DESCRIPTION OF A PREFERRED EMBODIMENT

Figure 1:
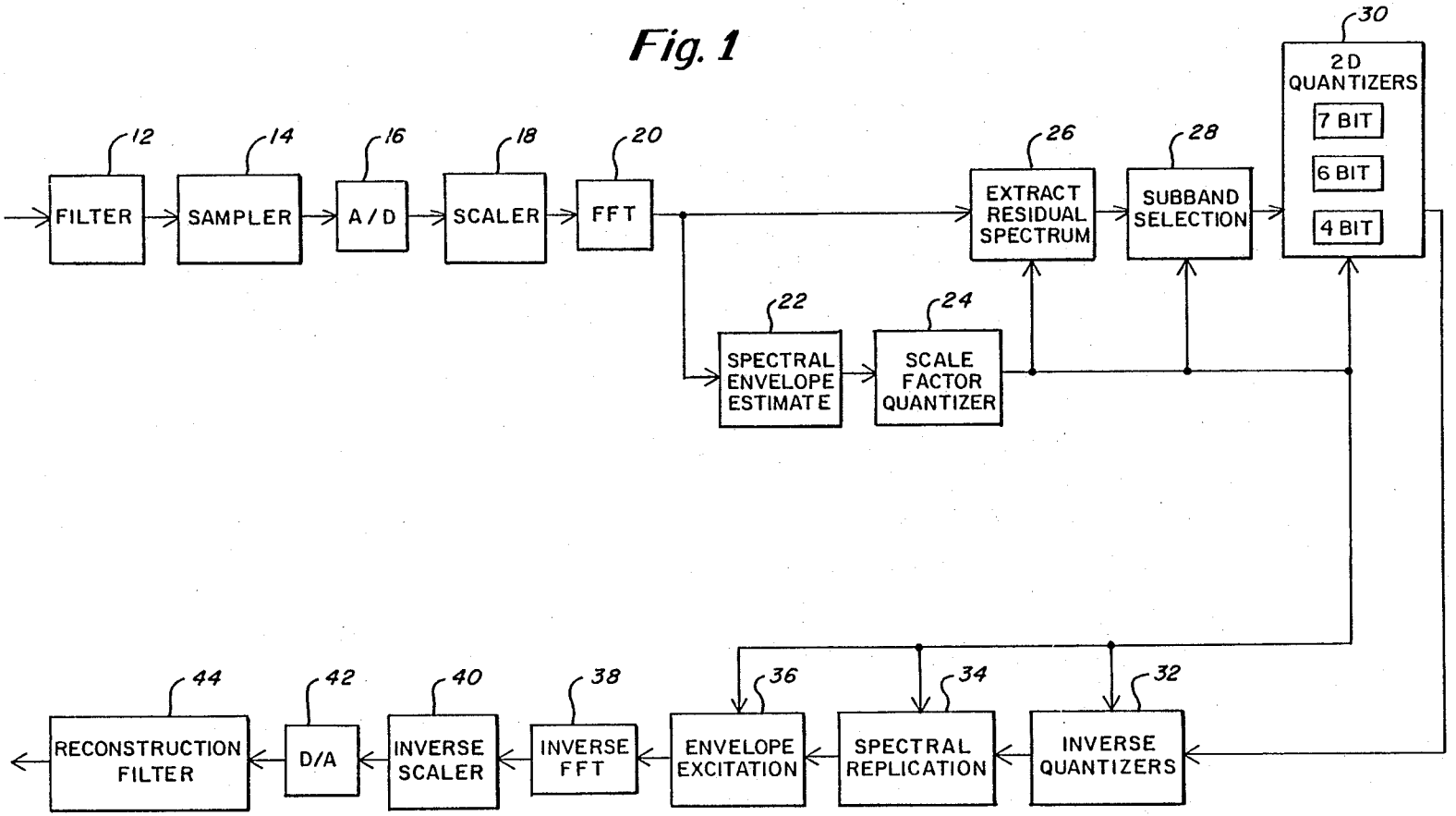
FIG. 1 is a block diagram of a speech encoder and corresponding decoder of a coding system embodying the present invention.

A block diagram of the coding system is shown in FIG. 1. Prior to compression, the analog speech signal is low pass filtered in filter 12 at 3.4 kilohertz, sampled in sampler 14 at a rate of 8 kilohertz, and digitized using a 12 bit linear analog to digital converter 16. It will be recognized that the input to the encoder may already be in digital form and may require conversion to the code which can be accepted by the encoder. The digitized speech signal, in frames of N samples, is first scaled up in a scaler 18 to maximize its dynamic range in each frame. The scaled input samples are then Fourier transformed in a fast Fourier transform device 20 to obtain a corresponding discrete spectrum represented by $(N/2)+1$ complex frequency coefficients.

In a specific implementation, the input frame size equals 180 samples and corresponds to a frame every 22.5 milliseconds. However, the discrete Fourier transform is performed on 192 samples, including 12 samples overlapped with the previous frame, preceded by trapezoidal windowing with a 12 point slope at each end. The resulting output of the FFT includes 97 complex frequency coefficients spaced 41.667 Hertz apart. The scaling and transform can be performed by a fast Fourier transform system such as described by Zibman and Morgan in U.S. patent application Ser. No. 765,918, filed Aug. 14, 1985, now U.S. Pat. No. 4,748,579.

Figure 2:
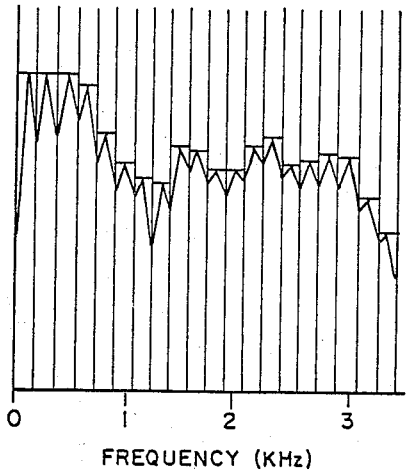
FIG. 2 is an example of a magnitude spectrum of the Fourier transform of a window of speech illustrating principles of the present invention.

An example magnitude spectrum of a Fourier transform output from FFT 20 is illustrated in FIG. 2. Although illustrated as a continuous function, it is recognized that the transform circuit 20 actually provides only 97 incremental complex outputs.

Following the basic approach of Zibman presented in U.S. application Ser. No. 684,382, the magnitude spectrum of the Fourier transform output is equalized and encoded. To that end, in accordance with the present invention, the spectrum is partitioned into contiguous subbands and a spectral envelope estimate is based on a piecewise approximation of those subbands at 22. In a specific implementation, the spectrum is divided into twenty subbands, each including four complex coefficients. Frequencies above 3291.67 Hertz are not encoded and are set to zero at the receiver. To equalize the spectrum, the spectral envelope of each subband is assumed constant and is defined by the peak magnitude in each subband as illustrated by the horizontal lines in FIG. 2. Each magnitude, or more correctly the inverse thereof, can be treated as a scale factor for its respective subband. Each scale factor is quantized in a quantizer 24 to four bits.

Figure 3:
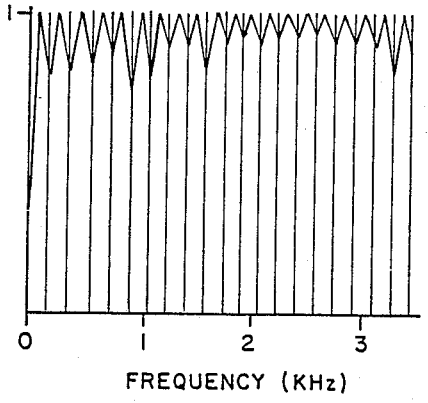
FIG. 3 is an example spectrum normalized from that of FIG. 2 based on principles of the present invention.

By then multiplying at 26 the magnitude of each coefficient of the spectrum by the scale factor associated with that coefficient, the flattened residual spectrum of FIG. 3 is obtained. This flattening of the spectrum is equivalent to inverse filtering the signal based on the piecewise-constant estimate of the spectral envelope.

Only selected subbands of the flattened spectrum of FIG. 3 are quantized and transmitted. Selection at 28 of subbands to be transmitted is based on the scale factor of the subbands. In a specific implementation, the 12 subbands having the smallest scale factors, that is the largest energy, are encoded and transmitted. For the eight lower energy subbands only the scale factors are transmitted.

A nonuniform bit allocation is used for the complex coefficients which are transmitted. Three separate two dimensional quantizers 30 are used for the transmitted 12 subbands. The sixteen complex coefficients of the four subbands having the smallest scale factors are quantized to seven bits each. The coefficients of the four subbands having the next smallest scale factors are quantized to six bits each, and the coefficients of the remaining four of the transmitted subgroups are quantized to four bits each. In effect, the coefficients of the eight subbands which are not transmitted are quantized to zero bits.

Each of the two dimensional quantizers is designed using an approach presented by Linde, et al., "An Algorithm for Vector Quantizer Design," *IEEE Trans on Commun,* Vol COM-28, pp. 84–95, January 1980. The result for the seven bit quantizer is shown in FIG. 4. The two dimensions of the quantizer are the real and imaginary components of each complex coefficient. Each cluster has a seven bit representation to which each complex point in the cluster is quantized. Actual quantization may be by table look-up in a read only memory.

The bit allocation for a single frame may be summarized as follows:

| | |
|---|---|
| Scale factors 20 × 4 bits each = | 80 bits |
| 16 × 7 bits = | 112 bits |
| 16 × 6 bits = | 96 bits |
| 16 × 4 bits = | 64 bits |
| Time scaling = | 4 bits |
| Synchronization = | 4 bits |
| TOTAL | 360 bits |

At the receiver, the transmitted 12 groups of coefficients are applied to corresponding seven bit, six bit and four bit inverse quantizers at 32. The frequency subbands to which the resulting coefficients correspond are determined by the scale factors which are transmitted in sequence for all subbands. Thus, the coefficients from the seven bit inverse quantizer are placed in the subbands which the scale factors indicate to be of the greatest magnitude.

The coefficients of the eight subbands which are not transmitted are approximated by replication of transmitted subbands at 34. To that end, a list replication approach is utilized. This approach is illustrated by FIG. 5. In FIG. 5, the coefficients for each subband are illustrated by a single vector. The transmitted subbands are indicated as T1, T2, T3, . . . Tn, . . . and the subbands which must be produced by replication in the receiver are indicated as R1, R2, R3, . . . Rn, . . . In accordance with the replication technique of the present system, the coefficients of the subband Tn are used both for Tn and for Rn. Thus, the scaled coefficients for subband T1 are repeated at subband R1, those of subband T2 are repeated at R2, and those at subband T3 are repeated at R3. The rationale for this list replication technique is that subbands are themselves usually grouped in blocks of transmitted subbands and blocks of nontransmitted subbands. Thus, large blocks of coefficients are typically repeated using this approach and speech harmonics are maintained in the replication process.

Once the equalized spectrum of FIG. 3 is recreated by replication of subbands, a reproduction of the spectrum of FIG. 2 can be generated at 36 by applying the scale factors to the equalized spectrum. From that Fourier transform reproduction of the original Fourier transform, the speech can be obtained through an inverse FFT 38, an inverse scaler 40, a digital to analog converter 42 and a reconstruction filter 44.

A distinct advantage of the present system over the prior Zibman approach is that the coder no longer assumes a fixed low pass spectrum model which is speech specific. Voice-band data and signaling take the form of sine waves of some bandwidth which may occur at any frequency. Where only a lower or an upper baseband of coefficients is transmitted, voice-band data can be lost. With the present system, the subbands in which digital information is transmitted are naturally selected because of their higher energy.

Another attractive feature of the ASET algorithm is its embedded data-rate codes capability. Embedded coding, important as a method of congestion control in telephone applications, allows the data to leave the encoder at a constant bit rate, yet be received at the decoder at a lower bit rate as some bits are discarded enroute. Embedded coding implies a packet or block of bits within which there is a hierarchy of subblocks. Least crucial subblocks can be discarded first as the channel gets overloaded. This hierarchical concept is a natural one in the present system where the partial-band information, described by a set of frequency coefficients, is ordered in a decreasing significance and the missing coefficients can always be approximated from the received ones. The more coefficients in the set, the higher is the rate and the better is the quality. However, speech quality degrades very gracefully with modest drops in the rate. The implementation of an embedded coding system in conjunction with this approach is therefore fairly simple and very attractive.

The coding technique described above provides for excellent speech coding and reproduction at 16 kilobits per second. Excellent results as low as 8.0 kilobits per second can be obtained by using this technique in conjunction with a frequency scaling technique known as time domain harmonic scaling and described by D. Malah, "Time Domain Algorithms for Harmonic Bandwidth Reduction and Time Scaling of Speech Signals", IEEE Trans. Acoust., Speech, Signal Processing, Vol. ASSP-27, pp. 121–133, April 1979. In that approach, prior to performing the fast Fourier transform, speech at twice the rate of the original speech but at the original pitch is generated by combining adjacent pitch cycles. The frequency scaled speech can then be fast Fourier transformed in the technique described above.

Although each of the steps of residual extraction, subband selection, and quantizing and the steps of inverse quantizing, replication and envelope excitation are shown as individual elements of the system, it will be recognized that they can be merged in an actual system. For example, the residual spectrum for subbands which are not transmitted need not be obtained. The system can be implemented using a combination of software and hardware.

While the invention has been particularly shown and described with reference to a preferred embodiment thereof, it will be understood by those skilled in the art that various changes in form and details may be made therein without departing from the spirit and scope of the invention as defined by the appended claims.

We claim:

1. A speech coding system comprising:

transform means for performing a discrete transform of a window of speech to generate a discrete transform spectrum of coefficients;

envelope defining and encoding means for defining an approximate envelope of the discrete spectrum in each of a plurality of subbands of coefficients and for encoding the defined envelope of each subband of coefficients;

means for scaling each spectrum coefficient relative to the defined envelope of the respective subband of coefficients; and coefficient encoding means for encoding the scaled spectrum coefficients within each subband in a number of bits determined by the defined envelope of the subband.

2. A speech coding system as claimed in claim 1 wherein the number of bits determined for a plurality of subbands is zero such that the scaled coefficients for those subbands are not transmitted.

3. A speech coding system as claimed in claim 2 wherein the scaled coefficients of different subbands are encoded in different numbers of bits other than zero.

4. A speech coding system as claimed in claim 2 wherein encoded speech is decoded by replicating subbands of transmitted coefficients as substitutes for subbands of nontransmitted coefficients such that the transmitted coefficients listed in order according to frequency are replicated as subbands of nontransmitted coefficients listed in order according to frequency.

5. A speech coding system as claimed in claim 1 wherein the coefficients of different subbands are encoded in different numbers of bits other than zero.

6. A speech coding system as claimed in claim 1 wherein the transform means performs a discrete Fourier transform.

7. A speech coding system as claimed in claim 6 wherein the number of bits determined for a plurality of subbands is zero such that the scaled coefficients for those subbands are not transmitted.

8. A speech coding system as claimed in claim 7 wherein the scaled coefficients of different subbands are encoded in different numbers of bits other than zero.

9. A speech coding system as claimed in claim 7 wherein encoded speech is decoded by replicating subbands of transmitted coefficients as substitutes for subbands of nontransmitted coefficients such that the transmitted coefficients listed in order according to frequency are replicated as subbands of nontransmitted coefficients listed in order according to frequency.

10. A speech coding system as claimed in claim 6 wherein the coefficients of different subbands are encoded in different numbers of bits other than zero.

11. A speech coding system comprising:

Fourier transform means for performing a discrete transform of a window of speech to generate a discrete transform spectrum of coefficients;

envelope defining and encoding means for defining an approximate envelope of the discrete spectrum in each of a plurality of subbands of coefficients and for encoding the defined envelope of each subband of coefficients;

means for scaling each spectrum coefficient relative to the defined envelope of the respective subband of coefficients; and coefficient encoding means for encoding the scaled coefficient of less than all of the subbands, the encoded scaled coefficients being those corresponding to the defined envelopes of greater magnitude, with the scaled coefficients of subbands corresponding to defined envelopes of greatest magnitudes being encoded in more bits than coefficients of subbands corresponding to defined envelopes of lesser magnitudes.

12. A speech coding system as claimed in claim 11 wherein encoded speech is decoded by replicating subbands of transmitted coefficients as substitutes for subbands of nontransmitted coefficients such that the transmitted coefficients listed in order according to frequency are replicated as subbands of nontransmitted coefficients listed in order according to frequency.

13. A method of coding speech comprising:

performing a discrete transform of a window of speech to generate a discrete spectrum of coefficients;

defining an approximate envelope of the discrete spectrum in each of a plurality of subbands of coefficients and digitally encoding the defined envelope of each subband of coefficients;

scaling each coefficient relative to the defined magnitude of the respective subband of coefficients; and encoding the scaled coefficients within each subband into a number of bits determined by the defined envelope of the subband.

14. The method as claimed in claim 13 wherein the discrete transform is a Fourier transform.

15. The method as claimed in claim 14 wherein the number of bits determined for a plurality of subbands is zero such that the scaled coefficients for those subbands are not transmitted.

16. The method as claimed in claim 15 wherein the scaled coefficients of different subbands are encoded in different numbers of bits other than zero.

17. The method as claimed in claim 15 wherein encoded speech is decoded by replicating subbands of transmitted coefficients as substitutes for subbands of nontransmitted coefficients such that the transmitted coefficients listed in order according to frequency are replicated as subbands of nontransmitted coefficients listed in order according to frequency.

18. A system as claimed in claim 14 wherein the coefficients are the coefficients of a Fourier transform spectrum of speech.

19. In a system in which a discrete signal is divided into a plurality of subbands of coefficients and only select subbands of coefficients are transmitted to a receiver as determined by the signal itself, a method of regenerating the discrete signal at the receiver comprising replicating subbands of transmitted coefficients as substitutes for subbands of nontransmitted coefficients such that the transmitted coefficients listed in order according to frequency are replicated as subbands of nontransmitted coefficients listed in order according to frequency.

* * * * *